US008622883B2

(12) United States Patent
Flynn

(10) Patent No.: US 8,622,883 B2
(45) **Date of Patent: *Jan. 7, 2014**

(54) METHOD OF MAKING CUSTOMIZABLE GIFT BOX

(76) Inventor: Timothy J. Flynn, Key Largo, FL (US)

( * ) Notice: Subject to any disclaimer, the term of this patent is extended or adjusted under 35 U.S.C. 154(b) by 951 days.

This patent is subject to a terminal disclaimer.

(21) Appl. No.: 12/496,410

(22) Filed: Jul. 1, 2009

(65) Prior Publication Data

US 2010/0009828 A1 Jan. 14, 2010

(51) Int. Cl.
*B31B 1/00* (2006.01)
*B31B 49/00* (2006.01)

(52) U.S. Cl.
USPC ..... 493/51

(58) Field of Classification Search
USPC ..... 493/50, 59, 76, 78, 79, 80; 40/312.638; 206/387.1; 229/87.18, 87.19, 116.5, 229/923
See application file for complete search history.

(56) References Cited

U.S. PATENT DOCUMENTS

| | | | | |
|---|---|---|---|---|
| 2,187,304 | A * | 1/1940 | Farmer | 229/135 |
| 3,485,112 | A * | 12/1969 | Goosmann | 74/579 R |
| 5,103,978 | A * | 4/1992 | Secor | 206/387.1 |
| 5,186,566 | A * | 2/1993 | Cameron | 402/79 |
| 5,337,943 | A | 8/1994 | Hendren | |
| 5,449,201 | A | 9/1995 | Miller et al. | |
| 5,893,587 | A | 4/1999 | Wong | |
| 6,086,107 | A | 7/2000 | Whistler et al. | |
| 7,726,696 | B2 | 6/2010 | Flynn et al. | |
| 7,794,812 | B2 * | 9/2010 | Sanford | 428/40.2 |
| 7,959,187 | B2 | 6/2011 | Flynn et al. | |
| 7,963,564 | B2 | 6/2011 | Flynn et al. | |
| 2008/0093427 | A1 | 4/2008 | Kuranda | |
| 2008/0141568 | A1 | 6/2008 | Flynn | |
| 2009/0295140 | A1 | 12/2009 | Flynn et al. | |
| 2009/0295143 | A1 | 12/2009 | Flynn et al. | |
| 2010/0102544 | A1 | 4/2010 | Flynn | |
| 2010/0102545 | A1 | 4/2010 | Flynn | |
| 2011/0186213 | A1 | 8/2011 | Flynn | |

FOREIGN PATENT DOCUMENTS

| | | | |
|---|---|---|---|
| JP | 2002-23636 | A | 1/2002 |
| JP | 2002-225071 | A | 8/2002 |
| JP | 2005-173300 | A | 6/2005 |
| WO | WO 92/16436 | | 10/1992 |

OTHER PUBLICATIONS

Co-pending U.S. Appl. No. 12/496,381, "Customizable Gift Box," filed Jul. 1, 2009.

* cited by examiner

*Primary Examiner* — Alexandra Elve
*Assistant Examiner* — John Paradiso
(74) *Attorney, Agent, or Firm* — Pauley Petersen & Erickson

(57) ABSTRACT

A method of making a customizable gift box includes the step of providing a box blank including a box bottom and a plurality of sidewalls having adjacent lateral edges. Appendages are positioned to overlap and join the adjacent lateral edges of the adjacent sidewalls. Each appendage includes a first relatively narrow edge, a second relatively wider opposing edge, and S-shaped side edges joining the first and second edges. The configuration of the appendages facilitates their removal from a label assembly that includes a face sheet and a back sheet, the face sheet including a removable carrier portion, a removable label, and the removable appendages in the carrier sheet. Once the sidewalls of the box blank are properly anchored using the appendages, the label assembly can be aligned and the label can be adhered to the box blank.

20 Claims, 5 Drawing Sheets

FIG. 3
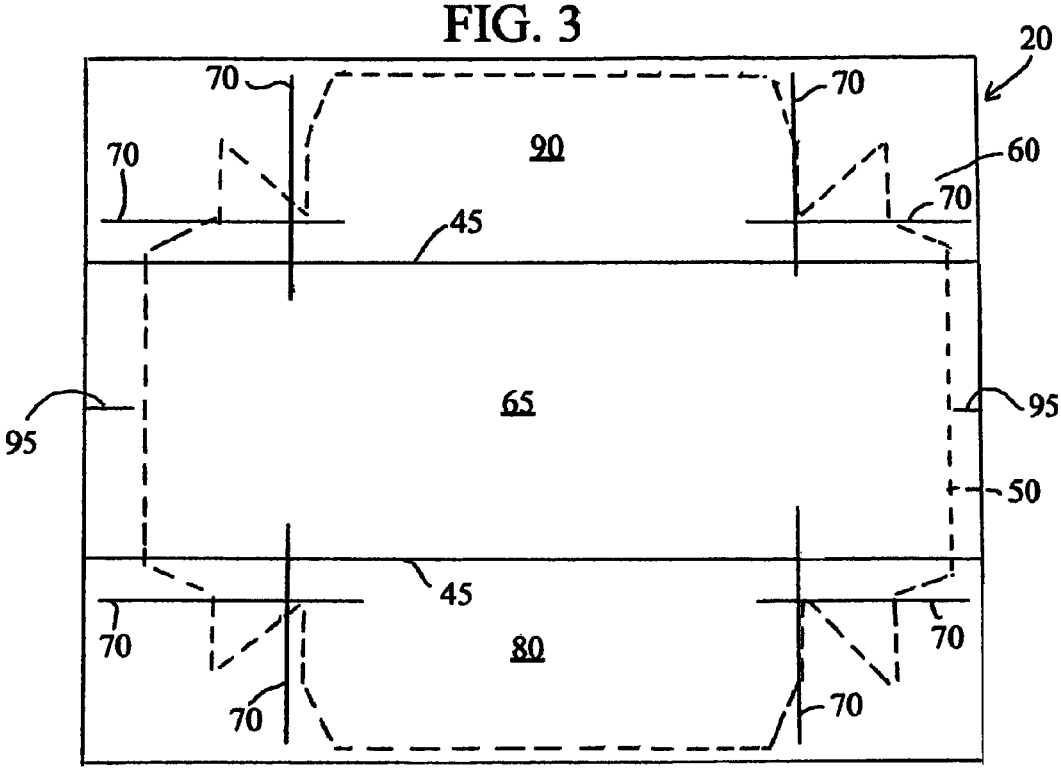
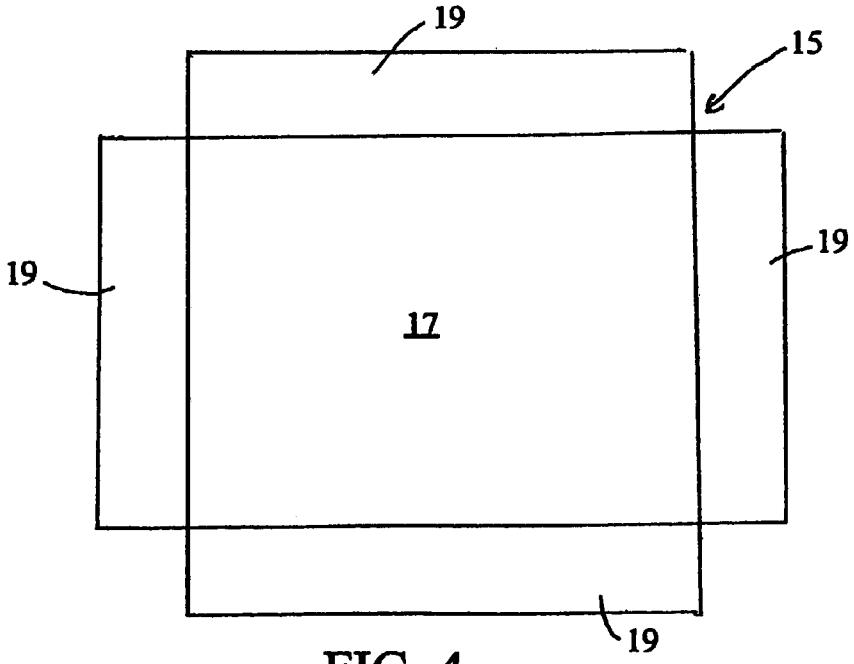
FIG. 4

FIG. 8
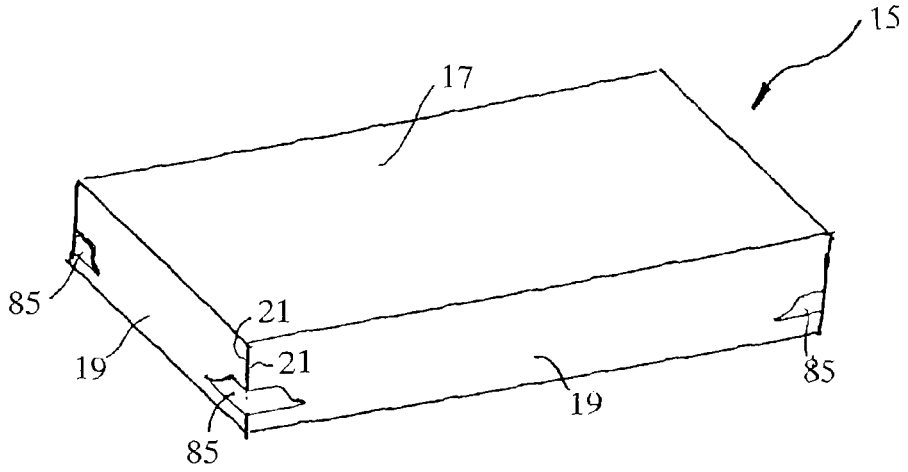
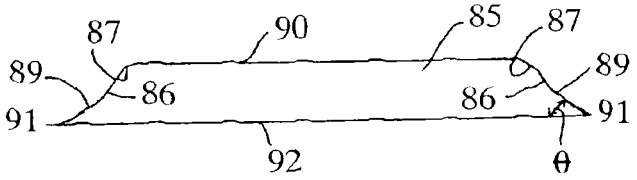
FIG. 9
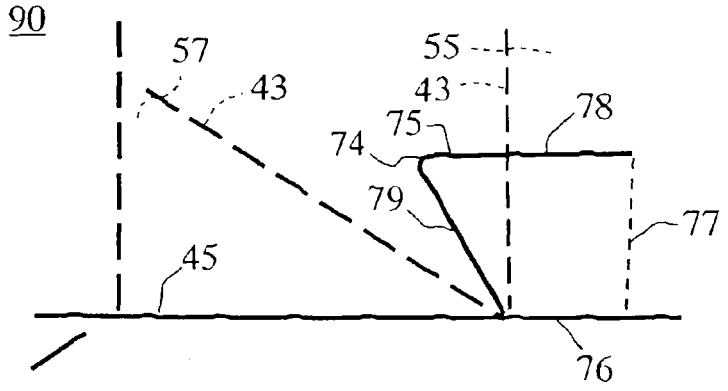
FIG. 10

METHOD OF MAKING CUSTOMIZABLE GIFT BOX

CROSS REFERENCE TO RELATED APPLICATIONS

This application is a continuation-in-part of U.S. patent application Ser. No. 11/585,653, filed on 24 Oct. 2006, now U.S. Pat. No. 8,033,040 the disclosure of which is incorporated by reference.

BACKGROUND OF THE INVENTION

1. Field of the Invention

This invention is directed to a customizable gift box that includes a box blank and a label assembly with a label having a printable surface.

2. Description of Related Art

Gift boxing and wrapping are necessary components of gift giving. Often, gift givers need dedicated space for wrapping paper of all varieties and boxes of various sizes and shapes to accommodate such gifts. Gift bags are one accommodation to the space requirements of traditional gift boxes and wrapping. However, like wrapping paper, gift bags are generally thematic and not all gift bags are appropriate for all gift giving situations.

As such, a need arises for a customizable gift box that a gift giver may design that is appropriate for the particular gift, event, occasion, season and/or recipient. Such customizable gift boxes eliminate the need for a gift giver to stock and/or independently purchase a tailor-made gift wrap or gift box for each particular gift, event, occasion, season and/or recipient.

SUMMARY OF THE INVENTION

It is an object of the present invention to provide a customizable gift box.

The above and other objects of this invention can be attained with a box blank and label assembly including a back sheet and a face sheet removably adhered to the back sheet.

The face sheet has a carrier portion and at least one label. An opposite back sheet is affixed to the face sheet. The face sheet preferably includes an adhesive material coating on one side facing the back sheet and a printable surface on an opposite side. The label assembly is preferably manufactured of a size and material to permit feeding into any number of standard printers, such as a consumer laser printer.

In operation, the label assembly preferably includes the face sheet having a printable surface including a label sized to cover at least a box bottom of the box blank. The label assembly is preferably customized by printing the label with a standard printer to include desired designs, writing, etc. appropriate to the situation.

The back sheet preferably includes a first removable portion at least partially overlaying the label. The first removable portion is preferably separable from the label assembly and removable to expose an adhesive surface of the label within the face sheet. The back sheet preferably further includes at least one index line for aligning the box blank relative to the label assembly, specifically relative to the label.

Thus, following removal of the first removable portion thereby exposing a partial surface of the label, at least one edge of the box blank can be aligned with one or more index lines without adhering the label to the box blank. Once aligned, the box blank can be adhered to the exposed section of the label and the remainder of the label can be applied to the box blank.

As a result of the label assembly as described, removal of one or more removable portions from the back sheet results in the label remaining in a carrier portion of the face sheet, preferably with the adhesive side facing upward. This configuration facilitates alignment and placement of the box blank without curling or unwanted adhesion that may result from peeling the label away from the back sheet.

Other objects and advantages of this invention are apparent to those skilled in the art, in view of the following detailed description taken in conjunction with the appended claims and drawings.

BRIEF DESCRIPTION OF THE DRAWINGS

The present invention can be better understood with reference to the following drawings. In the drawings, like reference numerals designate corresponding parts throughout the several views. The drawings are not necessarily to scale and emphasis is placed upon clearly illustrating principles of the present invention.

FIG. 3 is a plan view of a back sheet side of a label assembly opposite a face sheet side shown in FIG. 2, according to one preferred embodiment of this invention;

FIG. 4 is a plan view of a box blank according to one preferred embodiment of this invention;

FIG. 8 is a perspective view of a box blank illustrating the use of removable appendages from the face sheet shown in FIG. 6;

FIG. 9 is an enlarged plan view of a removable appendage from the face sheet shown in FIG. 6; and FIG. 10 is an exploded partial cutaway view of FIG. 7 showing the details of a foldable index tab.

DETAILED DESCRIPTION OF PREFERRED EMBODIMENTS

Figure 1:
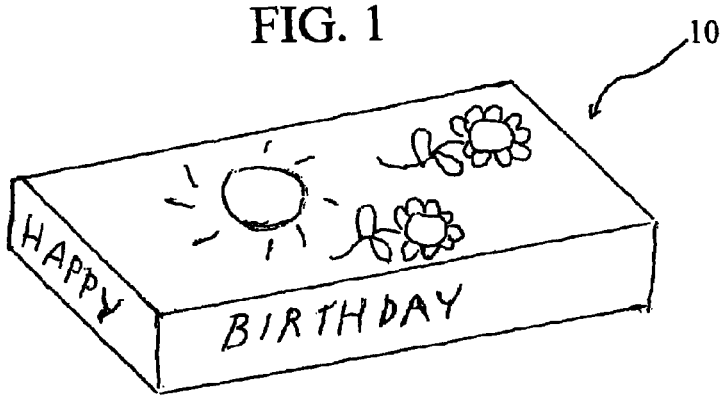
FIG. 1 is a perspective view of a gift box according to a preferred embodiment of this invention.
Figure 2:
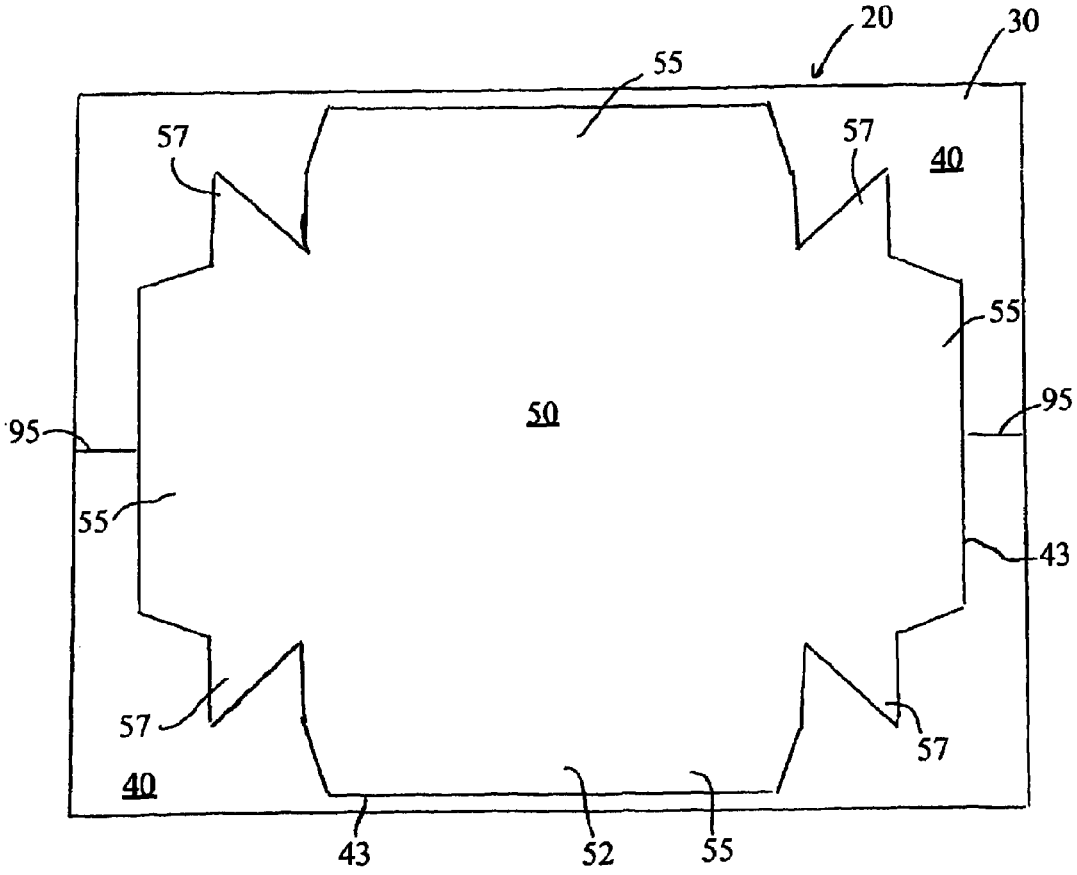
FIG. 2 is a plan view of a face sheet side of a label assembly according to one preferred embodiment of this invention.

The present invention is directed to a customizable gift box 10, such as shown in FIG. 1, including box blank 15 and label assembly 20, such as shown in FIGS. 2-4. Gift box 10 preferably includes box blank 15 and label assembly 20. At least a portion of label assembly 20 is preferably printable or otherwise customizable and then assembled with box blank 15 to result in a lid and/or base of the gift box 10.

According to a preferred embodiment of this invention, box blank 15 such as shown in FIG. 4, includes box bottom 17 and at least two, suitably four sidewalls 19. Box blank 15 may be constructed of cardboard, paper, card stock or other suitable material having similar and/or desirable properties for supporting gift box 10. As shown, sidewalls 19 are preferably foldable relative to box bottom 17 so as to form a general shape of gift box 10. As used herein, "gift box" may include a top, a bottom or entire box construction suitable for containing a gift or other object. It is contemplated that the "gift box" may include additional applications aside from gifts, such as business uses, postal uses or any other suitable use that requires a customizable box.

Label assembly 20 preferably includes a face sheet 30 and back sheet 60 removably adhered to face sheet 30. Face sheet 30 preferably includes carrier portion 40 and at least one label 50 that is removable from the back sheet 60 and separable from carrier portion 40. Label 50 preferably includes at least one printable surface 52 upon which information, decorations, personalization, etc. can be printed to customize gift box 10 formed from box blank 15 and label assembly 20.

FIGS. 2 and 3 show each side of a label assembly 20 (not necessarily shown to scale) according to one embodiment of this invention. Label sheet 20 is desirably formed of a face sheet 30, shown in FIG. 2, and an opposite back sheet 60, shown in FIG. 3. Back sheet 60 is desirably approximately the same size as face sheet 30, but may be slightly larger or smaller than face sheet 30. A surface of face sheet 30 that is disposed toward back sheet 60 preferably includes an adhesive material coating. The adhesive coating can include any adhesive material known and available to those skilled in the art for forming pressure sensitive, or self-adhesive labels.

Label assembly 20 is preferably of any suitable shape, and generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches. Face sheet 30 is preferably, but not necessarily, constructed of any suitable paper, paper composite, non-metal and/or metal material that can be used as a label. Other suitable materials for constructing face sheet 30 include fabric, plastic, and metal foils. The adhesive coating covered by back sheet 60 is preferably applied to face sheet 30 in any suitable manner known to those skilled in the art. Face sheet 30 desirably has a printable surface 52 on a side opposite the adhesive coating.

Face sheet 30 and printable surface 52 can be any of a variety of face materials used to make pressure sensitive, or self-adhesive labels. Such face materials may include, but are not limited to: smudge proof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. Customization on label 50 may include one or more images, patterns, print, pictures, drawings, letters, numbers, words and/or symbols, for example, to relate the gift giver, receiver and/or contents of the gift box 10 to the customization.

As briefly described above, a layer of an adhesive is preferably positioned between back sheet 60 and face sheet 30 so that the adhesive adheres to face sheet 30 exclusively or at least adheres to face sheet 30 more than to back sheet 60 when back sheet 60 is removed from face sheet 30, as described hereafter. As a result of this configuration, label assembly 20 preferably includes face sheet 30 having a printable side and an opposite, adhesive side and back sheet 60 including a separable side and an opposite side.

Face sheet 30 may include a plurality of shapes of labels 50, defined in face sheet 30 as one or more individual labels 50 according to this invention. The phrase label 50, "shape," or the phrase "removable or tearable shape," are intended to relate to a shape, such as the shapes identified in FIG. 2 by element reference numeral 50, that can be removed or torn away from a remaining carrier portion 40 of face sheet 30, such as by using tearable lines of separation 43. Specifically, as described below in more detail, label 50 is preferably dimensioned to cooperate with a particular box blank 15 depending on the size and shape of the gift box 10 desired.

Tearable lines of separation 43 can be formed as a line of weakness and/or cut in face sheet 30 known to those skilled in the art, such as die-cut lines, perforated lines, micro-perforated lines, or any combination of these types of separation, or any other suitable structure that enables separation. A preferred type of tearable line 43 is a line that is die-cut. Label 50 can be die-cut along at least a portion of a periphery, such that label 50 can be easily removed or separated from carrier portion 40 of face sheet 30, for example after label assembly 20 is run through a printer and removable portions 65, 80 and/or 90 of back sheet 60 are removed as described below.

In operation, label assembly 20 preferably includes face sheet 30 having printable surface 52 on label 50 that is sized to cover at least box bottom 17 of box blank 15. As described above, label assembly 20 is preferably customized by printing label 50 with a standard printer to include desired designs, writing, etc.

As shown in FIG. 3, two tearable lines of separation 45 extend the length of back sheet 60 and divide back sheet 60 into a first central removable portion 65, a second outer removable portion 80, and a third outer removable portion 90. The back sheet 60 preferably includes first removable portion 65 at least partially overlaying label 50 (shown in hidden lines) and carrier 40. Part or all of carrier 40 can be peeled away from back sheet 60, leaving label 50 (with or without portions of carrier 40) on the facing sheet 30. Preferably, carrier 40 is not removed until a later stage described below. First removable portion 65 is preferably separable from label assembly 20 and removable to expose an adhesive surface of label 50 within face sheet 30. First removable portion 65 is preferably exclusive to back sheet 60 and is removable along at least the two tearable lines of separation 45 extending through the back sheet 60, but not into face sheet 30. Tearable lines of separation 45 on the back sheet 60 can be formed as any line of weakness and/or cut as described above for tearable lines of separation 43 on face sheet 30.

As shown in FIG. 3, back sheet 60 preferably further includes at least one index line 70 for aligning box blank 15 relative to label assembly 20, specifically relative to label 50. Accordingly, following removal of first removable portion 65 thereby exposing a partial surface of label 50 (and possibly a portion of carrier 40, if not yet removed), at least one edge of box blank 15 can be aligned with one or more index lines 70 without adhering label 50 to box blank 15. Once aligned, box blank 15 can be adhered to the exposed section of label 50.

According to a preferred embodiment of this invention, not all of label 50 will be exposed following removal of first removable portion 65. As a result, second and/or third removable portions 80, 90 may also be removable from back sheet 60 to more fully expose label 50. The second and/or third removable portions 80, 90 preferably at least partially overlay label 50 and are removable to expose additional adhesive surface of label 50.

According to a preferred embodiment of the invention, and to facilitate proper and accurate alignment of box blank 15 relative to label 50, first removable portion 65 preferably includes a width smaller than a width of box bottom 17. As a result of the small width of first removable portion 65, box blank 15 can be aligned with label 50 along index lines 70 without unintentionally adhering portions of box bottom 17 to label 50. However, as described in more detail below, label 50 preferably includes a width wider than a width of box bottom 17.

Figure 5:
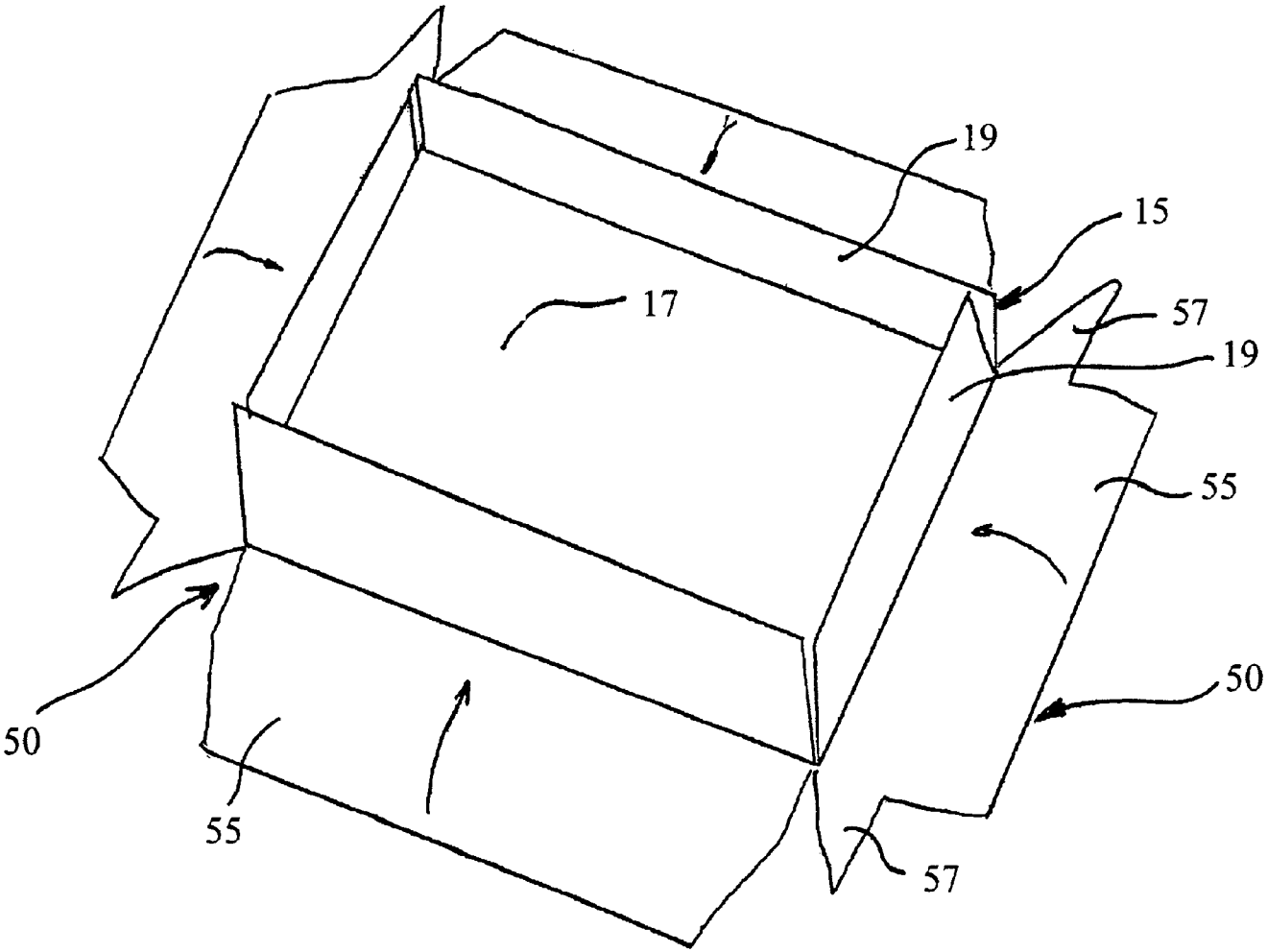
FIG. 5 is a perspective view of a box blank and label assembly following partial adhesion of a label according to a preferred embodiment of this invention.

Following removal of first, second and/or third removable portions 65, 80, 90 of label assembly 20, label assembly 20 is preferably positioned underneath box blank 15 with a portion of label 50 adhesively fixed to box blank 15. As shown in FIGS. 2 and 5, additional portions of label 50 preferably extend beyond box bottom 17 of box blank 15 in the form of tabs 55 thereby permitting sidewalls 19 of box blank to be entirely covered by label 50. In addition, one or more extended portions 57 of tabs 55 preferably extend outwardly from tabs 55 to permit adjoining of adjacent sidewalls 19 of box blank 15 to form gift box 10.

As shown in FIGS. 3 and 5, first removable portion 65 is preferably positioned along a center of label 50. As such, upon removal of first removable portion 65 from label assembly 20, box blank 15 is preferably indexable relative to each side of label 50 along remaining portions of back sheet 60.

In this manner, index lines 70 are preferably positioned outside of first removable portion 65 so that a visual index can be drawn between box blank 15 and label assembly 20. More specifically, two laterally extending index lines 70 and two longitudinally extending index lines 70 are preferably positioned one on either side of first removable portion 65. Index lines 70 are preferably inked or otherwise marked into back sheet 60 so as to be readily legible and apparent to a user. In addition, index lines 70 are preferably positioned along second removable portion 80 and/or third removable portion 90 of back sheet 60 and not in an exposed adhesive section of label 50. In this manner, box blank 15 may be aligned and adjusted without adhering label 50 to box bottom 17 or sidewalls 19.

Figure 7:
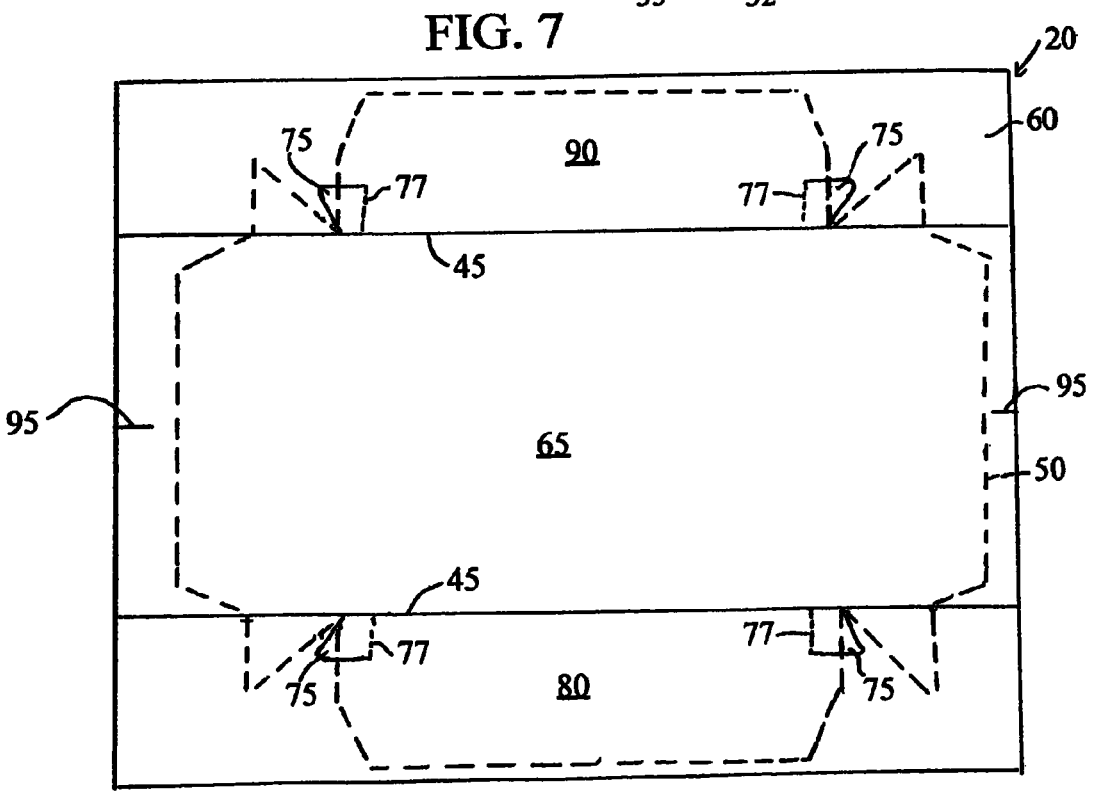
FIG. 7 is a plan view of an alternative back sheet side of a label assembly including foldable index tabs useful in place of index lines.

Index lines 70 constitute one type of indexing device. As an alternative to index lines 70, one or more other indexing devices can be used. FIG. 7 illustrates an embodiment of the invention in which index lines 70 are replaced by foldable index tabs 75, suitably four of the foldable index tabs 75, in the back sheet 60. A first pair of foldable index tabs 75 forms part of the second outer removable portion 80. A second pair of foldable index tabs 75 forms part of the third outer removable portion 90.

As shown in FIG. 10, each foldable index tab 75 has a foldable edge 77 (represented by the dotted line) and three removable edges 76, 78 and 79 represented by corresponding tearable lines of separation. The tearable lines of separation are formed in the corresponding outer removable portion (80 or 90) in the back sheet 60, and may be any of the lines of weakness and/or cut lines described above with respect to tearable lines 43 and 45. The three removable edges include an inner removable edge 76 which coincides with tearable line 45 between the second or third outer removable portion 80 or 90 and the first central removable portion 65, an opposing outer removable edge 78 within the outer removable portion 80 or 90, and a transverse removable edge 79 that is opposite the foldable edge 77 and between the inner and outer removable edges. The transverse removable edge 79 intersects the inner removable edge at a corner 74.

In order to lift the index tab 75 and use it to align the box blank 15 relative to label assembly 20, the user can lift up the corner 74 and cause the tab 75 to separate from the remainder of the outer removable portion 80 or 90 along removable edges 76, 78 and 79. This will also cause the tab 75 to fold along foldable line 77 so that it protrudes outward from the remainder of second or third outer removable portion 80 or 90. This procedure can be repeated four times, for all four tabs 75, in order to completely align the box blanks.

As shown in FIG. 10, it is advantageous to position the transverse removable edge 79 on the back sheet 60 at an angle so that it falls in between the tearable lines 43 used to separate the label 50 from the carrier portion 40 on the facing sheet 30. In other words, the index tabs 75 should be designed and positioned so that none of the removable edges 76, 78 or 79 in back sheet 60 coincides with a tearable line of separation on the facing sheet 30. This helps prevent spontaneous separation as the label assembly 20 passes through a printer, which can cause jamming of the printer. In the embodiment shown in FIG. 10, transverse removable edge 79 on back sheet 60 is positioned in between the nearest edges of tabs 55 and extended portions 57. The upper removable edge 78 is longer than the lower removable edge 76 so that the transverse edge 79 may connect each of them at an angle that is not a right angle, and is suitably about 30 to about 80 degrees, or about 40 to about 70 degrees.

In addition, second removable portion 80 and third removable portion 90 are preferably positioned along outer edges of label 50 so that, following indexing and adherence of center portion of label 50 to box bottom 17, the remaining portions of label 50 may be properly adhered to box blank 15 as described.

As a result of label assembly 20 as described, removal of first, second, third and/or additional removable portions 65, 80, 90 from back sheet 60, label 50 can remain in all or part of carrier portion 40 of face sheet 30, preferably with the adhesive side facing upward. This configuration facilitates alignment and placement of box blank 15 without curling or unwanted adhesion that may result from peeling label 50 away from back sheet 60. Following proper, aligned adhesion of label 50 to box blank 15, label 50 is removed from remainder of carrier portion 40 on face sheet 30 along tearable lines of separation 45, as previously described.

One or more score lines 95 may be positioned in back sheet 60 and/or face sheet 30 and preferably extend from at least one edge of first removable portion 65. Such score lines 95, unlike tearable lines of separation 45, preferably extend entirely through label assembly 20 and facilitate removal of first removable section 65 as well as separation of carrier portion 40 from label 50 during or following application of label 50 to box blank 15.

Figure 6:
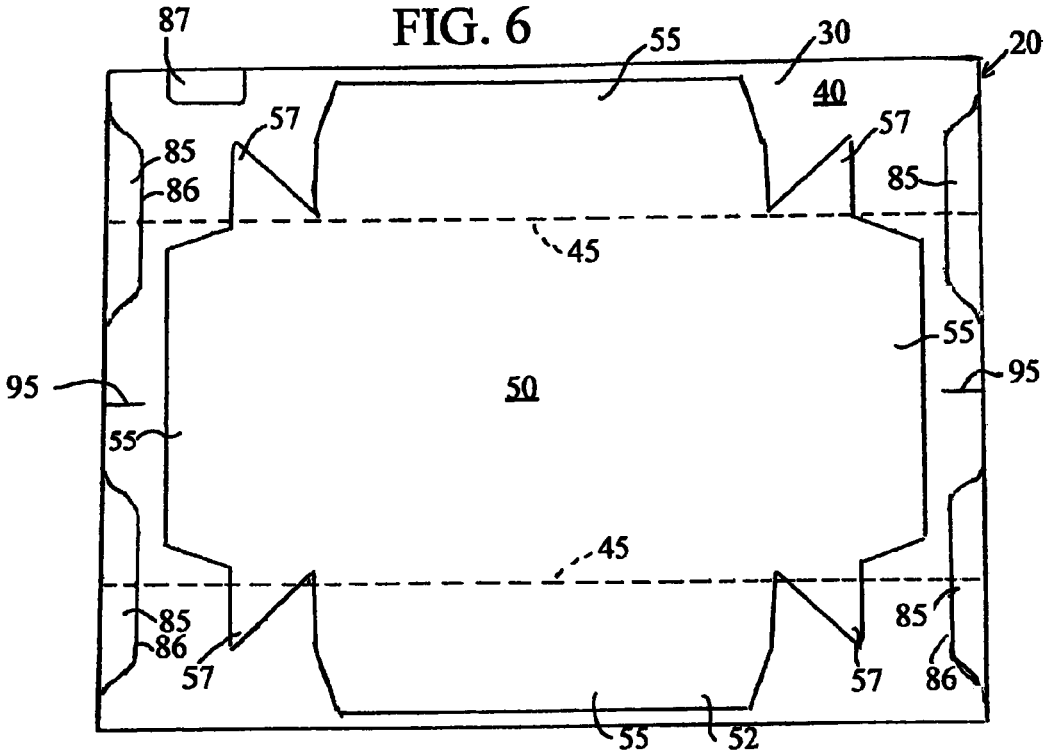
FIG. 6 is a plan view of an alternative face sheet side of a label assembly including removable appendages embedded in the carrier portion thereof.

In a further embodiment illustrated in FIG. 6, the carrier portion 40 of back sheet 60 is provided with removable appendages 85. Appendages 85 are useful for reinforcing the box blank 15 in a folded position by holding the adjacent sidewalls 19 together, as shown in FIG. 8.

Each removable appendage 85 can be manually removed from the carrier portion 40 along tearable lines of separation 86. Each tearable line of separation 86 can be formed as a line of weakness and/or cut in the face sheet 30. Examples of tearable lines of separation 86 include without limitation die-cut lines, perforated lines, micro-perforated lines, and combinations of the foregoing, as well as any other suitable structure that enables separation.

As shown in FIG. 9, each removable appendage 85 may include a first relatively narrower, relatively flat upper edge 90 and a second relatively wider, relatively flat opposing lower edge 92. The first and second edges are joined by S-shaped side edges 86. Each S-shaped side edge 86 includes a first upper concave portion 87 having a positive radius of curvature and a second lower convex portion 89 having a negative radius of curvature. The lower convex portion 89 of each side edge 86 converges with lower edge 92 at a point 91. As each side edge 86 approaches point 91, the angle θ between the side edge 86 and lower edge 92 is less than about 90 degrees, suitably about 15 to about 85 degrees, or about 40 to about 80 degrees.

The S-shaped side edges 86, having the lower convex portions 89 converging with lower edge 92 at points 91, facilitate easy removal and peeling of the appendages 85 from the back sheet 60 and carrier portion 40 without causing tearing or excessive bending of the appendages 85, back sheet 60 or remainder of carrier portion 40. In order to use the appendages 85, the following steps may be followed. First, in order to remove an appendage 85 from the back sheet 60 and carrier portion 40, the user may slightly bend the label assembly 20 at one of the points 91. The user may then manually grasp the appendage 85 at the point 91 and lift the appendage 85 off the back sheet 60 and away from carrier portion 40. The removed appendage 85 has a top surface and an adhesive-coated bottom surface.

The user may also fold the box blank 15 in the manner shown in FIG. 8. Specifically, the four sidewalls 19 of the box blank 15 are folded at about a 90-degree angle to the box bottom 17 so each lateral edge 21 of each sidewall 19 is positioned adjacent to a lateral edge 21 of an adjacent sidewall 19. Then, the appendage 85 is positioned to overlap two of the adjacent sidewalls 19 and gently pressed against the adjacent sidewalls 19 so that the adhesive-coated bottom surface bonds the appendage 85 to both of the adjacent sidewalls 19, thereby forming a joint between the adjacent lateral edges 21.

This procedure is repeated four times, forming a joint at each line of intersection between adjacent sidewalls 19 of the box blank 15. Then, as described above, at least the first removable portion 65 is removed from back sheet 60 along tear lines 65, exposing a portion of the adhesive-coated surface of label 50. At least one edge of box bottom 17 of box blank 15 can be aligned with one or more index lines 70, or other index devices such as the index tabs 75 described above. Suitably, all four edges of box bottom 17 are aligned in this fashion. Once aligned, box bottom 17 of box blank 15 can be adhered to the exposed section of label 50. Any remainder of carrier portion 40 is then removed from facing sheet 30 along tearable lines of separation 43, as described above.

Subsequently, second and/or third removable portions 80 and 90 can be removed from back sheet 60 to more fully expose label 50. The second and/or third removable portions 80 and 90 suitably at least partially overlay label 50 and are removable to expose additional adhesive-coated surface of label 50.

Following removal of first, second and third removable portions 65, 80 and 90 of back sheet 60, the remainder of label assembly 20 is positioned underneath box blank 15 with a portion of the label 50 adhesively fixed to the box bottom 17 of box blank 15. The remainder of label 50, specifically the tabs 55 and extended portions 57, are folded over and adhered to the sidewalls 19 of box blank 15, so as to cover exposed surfaces of the sidewalls 19 and conceal the appendages 85.

As shown in FIG. 6, one or more additional removable appendages can also be included in carrier portion 40 of face sheet 30 for various purposes. The illustrated removable appendage 87 can be used as a shopping label which identifies the specific label assembly 20 according to a code, to facilitate reordering.

In decorating label 50 according to one preferred embodiment of this invention, label assembly 20 is routed through a suitable printer. Information downloaded from an internet website or saved on a computer database for example, is printed on at least one printable surface 52 of face sheet 30. For example, in one preferred embodiment of this invention, a first set of information, such as an image of the gift recipient, is printed on printable surface 52 of label 50. In one preferred embodiment of this invention, a database containing or having a plurality of downloadable images is accessible from a personal computer or work station. At least one of the downloadable images can be selected to download. After the image is downloaded, the image is printed on label 50. As used in the specification and in the claims, the term "information" refers to any suitable or desirable electronic image or design, such as a digital photograph, picture, drawing, pattern, text and/or symbol.

While in the foregoing specification this invention has been described in relation to certain preferred embodiments thereof, and many details have been set forth for purpose of illustration, it will become apparent to those skilled in the art that the invention is susceptible to additional embodiments and that certain of the details described herein can be varied considerably without departing from the basic principles of the invention. Therefore, to particularly point out and distinctly claim the subject matter regarded as the invention, the following claims conclude the specification.

What is claimed is:

1. A method for making a customizable gift box, comprising the steps of:

providing a box blank including a box bottom and a plurality of sidewalls having lateral edges;

providing a label assembly including a face sheet, a back sheet, and an adhesive material coating one side of the face sheet and removably adhering the face sheet to the back sheet, the face sheet including a carrier portion, a label, and at least one tearable line of separation enabling removal of the carrier portion from the label, the carrier portion including the appendage removably affixed to the back sheet and separable from the remainder of the carrier portion along at least one tearable line of separation;

folding the side walls with respect to the box bottom so that a lateral edge of each sidewall is positioned adjacent to a lateral edge of an adjacent sidewall;

positioning the appendage to overlap and join a lateral edge of at least one sidewall to the adjacent lateral edge of an adjacent sidewall, the appendage including a first relatively narrow edge, a second relatively wider opposing edge, and S-shaped side edges joining the first and second edges; and adhering the label to the box blank to cover at least the box bottom.

2. The method of claim 1, further comprising the step of folding the label over the sidewalls so that the label covers exposed surfaces of the sidewalls and conceals the appendage.

3. The method of claim 1, wherein the box blank covers four of the sidewalls, further comprising the step of positioning four of the appendages so that they overlap and join the lateral edges of each of the four sidewalls to the adjacent lateral edge of each adjacent sidewall.

4. The method of claim 1, wherein each S-shaped side edge of the appendage comprises a first concave portion having a positive radius of curvature and a second convex portion having a negative radius of curvature, and approaches the second wider edge of the appendage at an angle of about 15 degrees to about 85 degrees.

5. The method of claim 1, further comprising:

removing the appendage from the carrier portion before affixing it to the adjacent sidewalls of the box blank and removing at least a portion of the back sheet before adhering the label to the box blank.

6. The method of claim 1, wherein the carrier portion includes four of the appendages removably affixed to the back sheet and separable from the remainder of the carrier portion along tearable lines of separation.

7. A method of making a customizable gift box, comprising the steps of:

providing a label assembly including a face sheet, a back sheet, and an adhesive material coating one side of the face sheet and removably adhering the face sheet to the back sheet, the face sheet including a carrier portion, a label, at least one tearable line of separation enabling removal of the carrier portion from the label, at least one removable appendage in the carrier portion, and at least one tearable line of separation enabling removal of the appendage from a remainder of the carrier portion, the back sheet including an indexing device and a removable portion at least partially overlaying the label to expose an adhesive surface of the label;

providing a box blank including a box bottom and a plurality of sidewalls having lateral edges;

folding the sidewalls with respect to the box bottom so that a lateral edge of each sidewall is positioned adjacent to a lateral edge of an adjacent sidewall;

removing the appendage from the carrier portion and positioning the appendage on the box blank so that it overlaps and joins a lateral edge of at least one sidewall to a lateral edge of an adjacent sidewall;

removing the removable portion to expose the adhesive material;

aligning the box blank with the indexing device;

placing the box blank on the exposed adhesive material; and adhering the label to the box blank so that it covers at least the box bottom.

8. The method of claim 7, further comprising the step of providing the removable appendage with a first relatively narrow edge, a second relatively wider opposing edge, and S-shaped side edges joining the first and second edges.

9. The method of claim 8, wherein each S-shaped side edge of the appendage is provided with a first concave portion having a positive radius of curvature and a second convex portion having a negative radius of curvature, the second convex portion approaching the second wider edge of the appendage at an angle of about 15 degrees to about 85 degrees.

10. The method of claim 9, further comprising the step of folding the label over the sidewalls so that the label covers exposed surfaces of the sidewalls and conceals the appendage.

11. The method of claim 9, further comprising the step of positioning four of the removable appendages in the carrier portion.

12. The method of claim 11, further comprising the step of providing each of the four removable appendages with a first relatively narrow edge, a second relatively wider opposing edge, and S-shaped side edges joining the first and second edges.

13. The method of claim 12, wherein the box blank comprises four of the sidewalls, further comprising the steps of removing the four appendages from the carrier portion and positioning them on the box blank so that they overlap and join the lateral edges of each of the four sidewalls to the adjacent lateral edges of each adjacent sidewall.

14. A method for making a customizable gift box, comprising the steps of:

providing a label assembly including a face sheet and a back sheet;

the face sheet including a carrier portion, a label separable from the carrier portion;

the back sheet including a first removable center portion, a second removable outer portion, and a third removable outer portion, the second and third outer removable portions each including foldable index tabs;

providing a box blank including a box bottom and a plurality of sidewalls having lateral edges;

removing the first removably center portion of the back sheet;

aligning the box blank relative to the label using the foldable index tabs; and adhering the label to the box blank so that it covers at least the box bottom.

15. The method of claim 14, further comprising the steps of removing the second removable outer portion and the third removable outer portion from the back sheet and folding the label over the sidewalls so that it covers exposed surfaces of the sidewalls.

16. The method of claim 15, further comprising the step of removing the carrier portion from the face sheet.

17. The method of claim 14, further comprising the step of raising the foldable index tab toward an upright position above the second and third outer removable portions.

18. The method of claim 14, wherein each foldable index tab comprises an inner removable edge, an opposing outer removable edge, a transverse removable edge between the inner and outer removable edges, and a foldable edge opposite the transverse removable edge.

19. The method of claim 14, wherein the face sheet comprises at least one removable appendage including a first relatively narrow edge, a second relatively wider opposing edge, and S-shaped side edges joining the first and second edges, and further comprising the steps of removing the appendage from the carrier portion and positioning the appendage on the box blank so that it overlaps and joins a lateral edge of at least one sidewall to lateral edge of an adjacent sidewall.

20. The method of claim 19, wherein the box blank comprises four of the sidewalls, further comprising the steps of removing four appendages from the carrier portion and positioning them on the box blank so that they overlap and join lateral edges of each of the four sidewalls to adjacent lateral edges of adjacent sidewalls.

* * * * *